US011256282B2

(12) United States Patent
Kawaguchi et al.

(10) Patent No.: US 11,256,282 B2
(45) Date of Patent: Feb. 22, 2022

(54) CONTROL LEVER DEVICE OF INDUSTRIAL VEHICLE

(71) Applicant: KABUSHIKI KAISHA TOYOTA JIDOSHOKKI, Kariya (JP)

(72) Inventors: Kenichiro Kawaguchi, Aichi-ken (JP); Hideki Nakashima, Aichi-ken (JP); Kazushi Kamiya, Aichi-ken (JP); Nobuaki Kawabata, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 6 days.

(21) Appl. No.: 16/913,268

(22) Filed: Jun. 26, 2020

(65) Prior Publication Data

US 2021/0004039 A1 Jan. 7, 2021

(30) Foreign Application Priority Data

Jul. 2, 2019 (JP) ..... JP2019-123676

(51) Int. Cl.

| | |
|---|---|
| ***G05G 1/04*** | (2006.01) |
| ***G05G 1/01*** | (2008.04) |
| ***E02F 9/20*** | (2006.01) |
| ***G05G 1/02*** | (2006.01) |
| ***G05G 1/06*** | (2006.01) |

(52) U.S. Cl.

CPC ..... *G05G 1/01* (2013.01); *E02F 9/2004* (2013.01); *G05G 1/02* (2013.01); *G05G 1/06* (2013.01)

(58) Field of Classification Search

CPC .. G05G 1/04; G05G 1/06; G05G 1/02; G05G 1/10; G05G 9/04788; G05G 2009/04774; E02F 9/2004; H01H 9/06; H01H 2009/068; H01H 2009/066; H01H 13/08

See application file for complete search history.

(56) References Cited

U.S. PATENT DOCUMENTS

| | | | | |
|---|---|---|---|---|
| 6,092,976 | A | 7/2000 | Kamiya | |
| 6,164,415 | A * | 12/2000 | Takeuchi | B66F 9/22 187/223 |
| 6,557,586 | B1 * | 5/2003 | Lockyer | B66F 9/22 137/637 |
| 2005/0279561 | A1 | 12/2005 | Shearer et al. | |

(Continued)

FOREIGN PATENT DOCUMENTS

| | | | | |
|---|---|---|---|---|
| EP | 0866027 | A2 | 9/1998 | |
| EP | 1811534 | * | 7/2007 | H01H 9/06 |

(Continued)

*Primary Examiner* — Richard W Ridley
*Assistant Examiner* — Brian J McGovern
(74) *Attorney, Agent, or Firm* — Sughrue Mion, PLLC

(57) ABSTRACT

A control lever device of an industrial vehicle includes a control lever that is tiltable forward and rearward relative to a vehicle body of the industrial vehicle and that includes a control knob, a switch button that is provided on the control knob and adapted to be pushable while the control lever is operated. The switch button has a movement axis indicating a movable direction of the switch button. The movement axis is inclined forward relative to a direction orthogonal to an extending direction of the control knob so that a pushing direction of the switch button is directed rearward from the direction orthogonal to the extending direction of the control knob.

4 Claims, 6 Drawing Sheets

(56) References Cited

U.S. PATENT DOCUMENTS

| | | | | |
|---|---|---|---|---|
| 2007/0221010 | A1* | 9/2007 | Hanson | G05G 1/04 74/519 |
| 2008/0308400 | A1 | 12/2008 | States et al. | |
| 2009/0139360 | A1* | 6/2009 | Diccion | G05G 1/06 74/471 XY |
| 2013/0333510 | A1* | 12/2013 | Paakkinen | G05G 9/04788 74/490.12 |
| 2016/0304180 | A1* | 10/2016 | Steven | G05G 1/58 |

FOREIGN PATENT DOCUMENTS

| | | | |
|---|---|---|---|
| JP | 60-184724 | U | 12/1985 |
| JP | 09-295800 | A | 11/1997 |
| JP | 2007-272837 | A | 10/2007 |
| JP | 2012-139133 | A | 7/2012 |

* cited by examiner

CONTROL LEVER DEVICE OF INDUSTRIAL VEHICLE

CROSS-REFERENCE TO RELATED APPLICATION

This application claims priority to Japanese Patent Application No. 2019-123676 filed on Jul. 2, 2019, the entire disclosure of which is incorporated herein by reference.

BACKGROUND ART

The present disclosure relates to a control lever device of an industrial vehicle.

A tilt control device of a forklift truck described in Japanese Patent Application Publication No. H09-295800, for example, has been known as a technique relating to a conventional control lever device of an industrial vehicle. The Publication describes that a button switch as a switching means is provided on a control knob of a tilt control lever of a forklift truck. The button switch is operated to activate or deactivate a control process performed by a control device. Specifically, pushing the button switch during a tilt operation deactivates detection of the horizontal angle of forks, so that the tilt operation is not stopped even after the forks are positioned horizontally. In the case of the button switch of the tilt control lever described in the Publication, the length of time for which an operator keeps pushing the button switch during a tilt operation is relatively short.

Meanwhile, there are various industrial vehicles, such as roll clamp forklift trucks and bale clamp forklift trucks including a clamping attachment for holding or clamping a load. These types of industrial vehicles each have a clamping control lever for opening and closing a pair of clamp arms. The clamping control lever has on an upper portion of a control knob thereof a switch button adapted to be pushed with an index finger. The direction in which the switch button is pushed is orthogonal to an extending direction of the control knob. These types of industrial vehicles are configured such that the clamp arms are opened when an operator operates the clamping control lever in a specified direction for causing the clamp arms to open while pushing the switch button. Thus, without pushing the switch button, the clamp arms are not opened even though the operator operates the clamping control lever in the direction for opening the clamp arms. This configuration prevents a load held by the clamp arms from being dropped even when the clamping control lever is incorrectly operated.

However, in the case of an industrial vehicle including an attachment for clamping a load, in order to move the damp arms in a direction in which the damp arms are opened, an operator needs to operate the clamping control lever while keeping pushing the switch button of the clamping control lever, which corresponds to the control lever of the present disclosure. Thus, there has been a problem that the length of time for which the operator keeps pushing the switch button is longer as compared with a case of pushing a switch button provided on a tilt control lever, so that the burden on the operator is increased. In particular, since the pushing direction of the switch button is orthogonal to the extending direction of the control knob, when the operator pushes such a switch button during the operation of the damping control lever, the finger pushing the switch button gets tired easily.

The present disclosure has been made in view of the circumstances above, and is directed to providing a control lever device of an industrial vehicle that reduces a burden on an operator caused by operation of a control lever.

SUMMARY

In accordance with an aspect of the present disclosure, there is provided a control lever device of an industrial vehicle that includes a control lever that is tiltable forward and rearward relative to a vehicle body of the industrial vehicle and that includes a control knob, a switch button that is provided on the control knob and adapted to be pushable while the control lever is operated. The switch button has a movement axis indicating a movable direction of the switch button. The movement axis is inclined forward relative to a direction orthogonal to an extending direction of the control knob so that a pushing direction of the switch button is directed rearward from the direction orthogonal to the extending direction of the control knob.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

First Embodiment

A control lever device of an industrial vehicle according to a first embodiment of the present disclosure will hereinafter be described with reference to the accompanying drawings. The present embodiment is an example in which the control lever device is applied to a forklift truck as the industrial vehicle. It is to be noted that "forward", "rearward", "right", "left", "upper" and "lower" herein are used to indicate directions with reference to an operator of the forklift truck who is seated on a driver's seat in a driver's compartment, facing a forward travel direction of the forklift truck.

Figure 1:
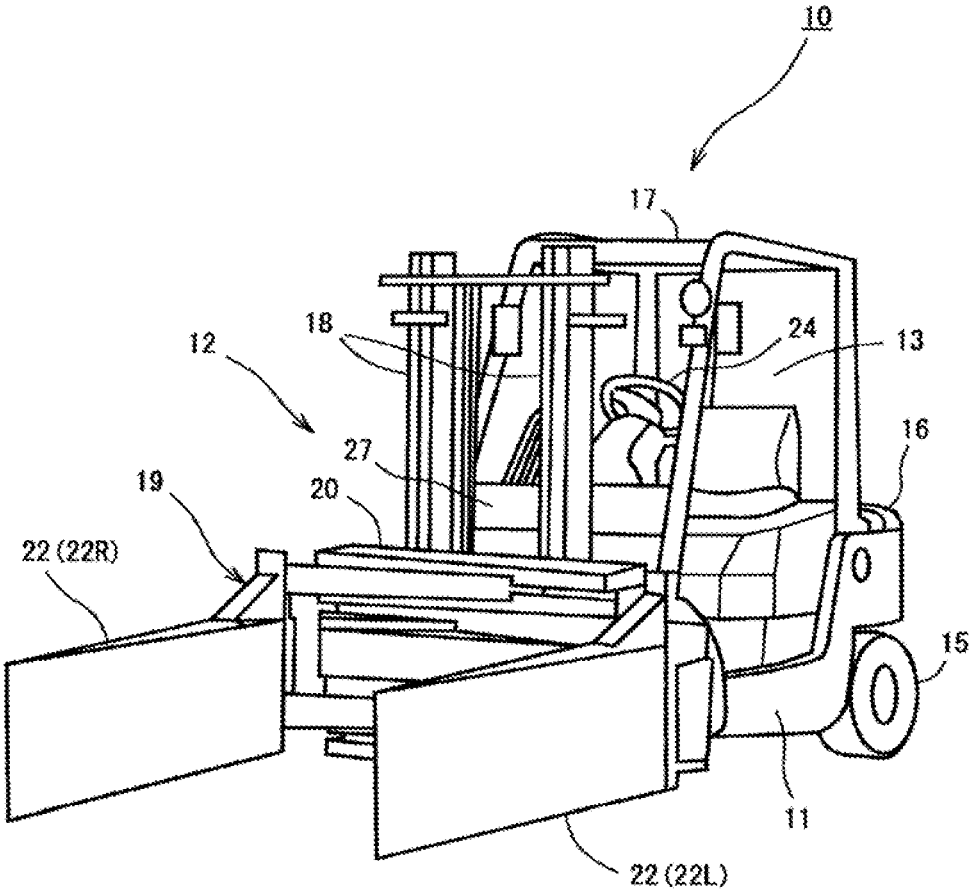
FIG. 1 is a perspective view of a forklift truck according to a first embodiment of the present disclosure.

As illustrated in FIG. 1, a forklift truck 10 includes a load-handling device 12 in a front part of a vehicle body 11 of the forklift truck 10. A driver's compartment 13 is provided at a center portion of the vehicle body 11. Drive wheels (not shown) as the front wheels are attached at the front of the vehicle body 11, and steered wheels 15 as the rear wheels are attached to the rear of the vehicle body 11. The forklift truck 10 includes a counterweight 16 in a rear part of the vehicle body 11. The counterweight 16 is adapted to adjust the weight of the forklift truck 10 and to keep the weight balance of the vehicle body 11. An engine (not shown) is mounted in the vehicle body 11. The vehicle body 11 includes an overhead guard 17 provided over the driver's compartment 13.

The load-handling device 12 of the first embodiment includes a pair of right and left masts 18 and a bale clamp 19 as the attachment. Each of the masts 18 includes a lift cylinder (not shown) for raising and lowering the bale clamp 19. The lift cylinders are single-acting hydraulic cylinders. The load-handling device 12 includes a pair of tilt cylinders (not shown) connecting the masts 18 to the vehicle body 11. The tilt cylinders cause the bale clamp 19 to tilt forward and rearward with respect to the vehicle body 11 in accordance with extension and retraction of rods of the tilt cylinders. The tilt cylinders are double-acting hydraulic cylinders.

The bale clamp 19 includes a clamp base 20 and a pair of right and left clamp arms 22 (22R, 22L). The damp base 20 has a plurality of upper and lower rail holders (not shown). One of the damp arms 22 that is on the right side is movable to the right and left along the rail holders in accordance with extension and retraction of a clamp cylinder (not shown) for the right clamp arm 22R that is connected to the clamp base 20. The other of the clamp arms 22 that is on the left side is movable to the right and left along the rail holders in accordance with extension and retraction of a clamp cylinder (not shown) for the left clamp arm 22L that is connected to the clamp base 20. The clamp cylinders are double-acting hydraulic cylinders.

Figure 2:
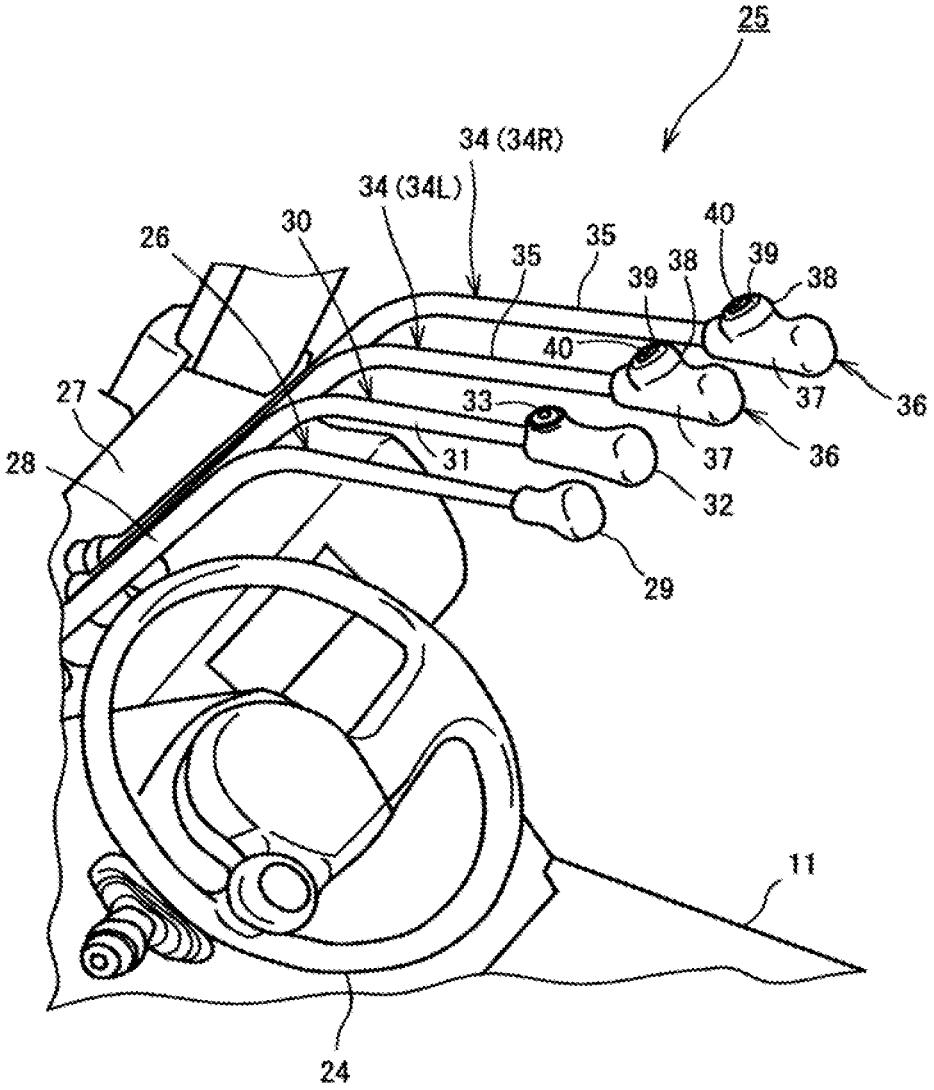
FIG. 2 is a perspective view of a control lever device of the forklift truck according to the first embodiment.

As illustrated in FIG. 2, the driver's compartment 13 in the vehicle body 11 is equipped with a steering wheel 24 and a control lever device 25 that includes a plurality of control levers. One of the control levers, which is located closest to the steering wheel 24, is a lift control lever 26. The lift control lever 26 is tiltable forward and rearward relative to the vehicle body 11, and includes a lift control lever body 28 that is slanted obliquely rearward from an instrumental panel 27, and a control knob 29 coupled to a leading end portion (the rear end portion) of the lift control lever body 28. When the lift control lever 26 is tilted rearward, the bale clamp 19 is raised relative to the masts 18, while when the lift control lever 26 is tilted forward, the bale clamp 19 is lowered relative to the masts 18.

Figure 3A:
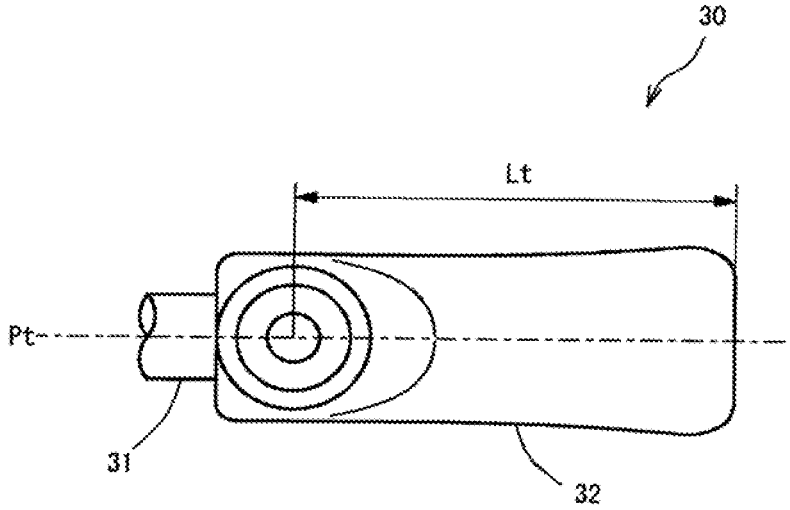
FIG. 3A is a plan view of a main part of a tilt control lever.
Figure 3B:
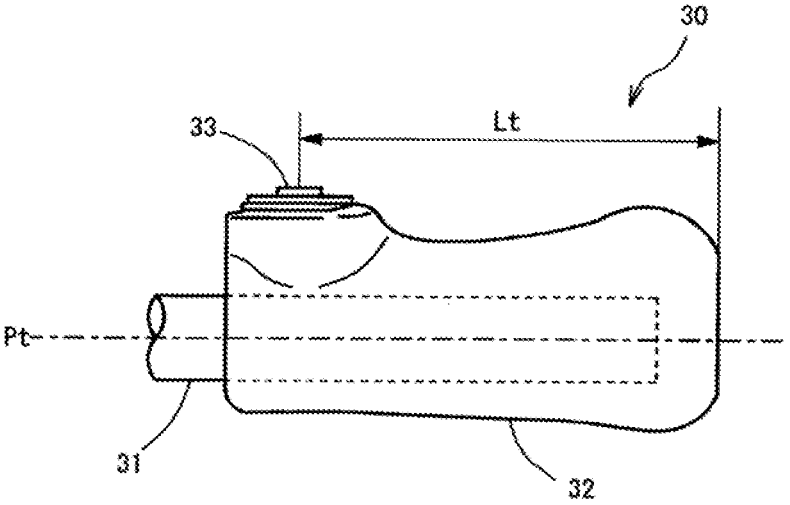
FIG. 3B is a side view of the main part of the tilt control lever of FIG. 3A.

As illustrated in FIG. 2, the control lever device 25 includes a tilt control lever 30 disposed on the right side of the lift control lever 26. The tilt control lever 30 is tiltable forward and rearward relative to the vehicle body 11, and includes a tilt control lever body 31 that is slanted obliquely rearward from the instrumental panel 27, and a control knob 32 coupled to a leading end portion (the rear end portion) of the tilt control lever body 31. As illustrated in FIGS. 3A and 3B, the control knob 32 extends along an extending direction of a central axis Pt of the tilt control lever body 31. An outer diameter of the control knob 32 is gradually increased as the control knob 32 extends rearward. A switch button 33 adapted to be pushable while the tilt control lever 30 is operated is provided on an upper portion of the control knob 32. The switch button 33 is located near an end portion (the front end portion) opposite from the rear end portion of the control knob 32. The switch button 33 is adapted to be pushable in a direction orthogonal to an extending direction of the control knob 32. As illustrated in FIGS. 3A and 3, there is a distance Lt between the intersection of the rear end of the control knob 32 of the tilt control lever 30 and the central axis Pt and the center of the switch button 33 in the extending direction of the central axis Pt of the rear end portion of the tilt control lever body 31.

When the tilt control lever 30 is tilted rearward, the clamp arms 22 are tilted rearward, while when the tilt control lever 30 is tilted forward, the clamp arms 22 are tilted forward. Also, when the tilt control lever 30 is tilted forward with the switch button 33 pushed, the forward tilting motion of the clamp arms 22 is stopped when the clamp arms 22 are positioned horizontally. Meanwhile, when the clamp arms 22 are tilted forward without pushing the switch button 33, the forward tilting motion of the clamp arms 22 is continued even after the clamp arms 22 are positioned horizontally.

As illustrated in FIG. 2, the control lever device 25 includes a pair of right and left clamping control levers 34 (34R, 34L) on the right side of the tilt control lever 30. The clamping control levers 34 are tiltable forward and rearward relative to the vehicle body 11. The clamping control lever 34R is a control lever for moving the right clamp arm 22R to the right and left. The clamping control lever 34L is a control lever for moving the left damp arm 22L to the right and left. The clamping control lever 34R is located at the rightmost side among the plurality of the control levers, and the clamping control lever 34L is located between the tilt control lever 30 and the damping control lever 34R. The damping control levers 34R and 34L have the same configuration. Therefore, only the clamping control lever 34R is described herein in detail. The description of the damping control lever 34R is applicable to the damping control lever 34L.

Figure 4A:
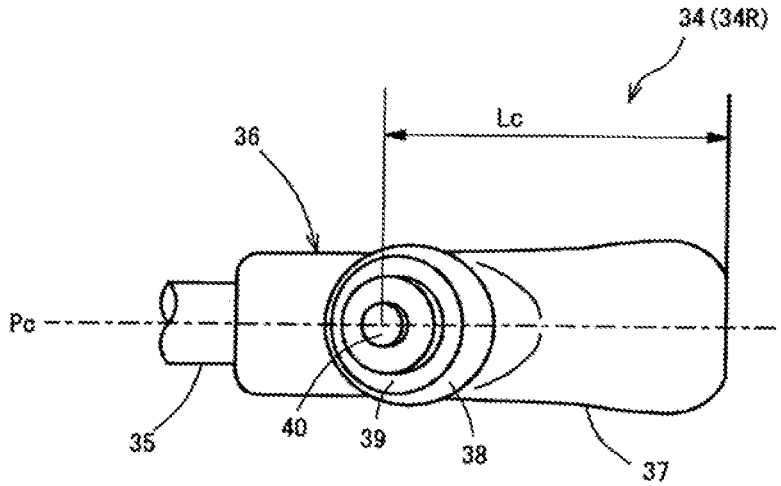
FIG. 4A is a plan view of a main part of a clamping control lever.

The clamping control levers 34 (34R) includes a clamping control lever body 35 that is slanted obliquely rearward from the instrumental panel 27, and a control knob 36 coupled to a leading end portion (the rear end portion) of the damping control lever body 35. The control knob 36 includes a knob body 37 and a raised portion 38 formed to rise from the knob body 37. As illustrated in FIGS. 4A and 48, the knob body 37 extends along an extending direction of the clamping control lever body 35. An outer diameter of the control knob 36 is gradually increased as the control knob 36 extends rearward. As illustrated in FIG. 48, part of the rear end portion of the clamping control lever body 35 is inserted into substantially the center of the knob body 37. The control knob 36 has a specified knob length in the extending direction of the control knob 36. In the first embodiment, the knob length of the control knob 36 is 75 mm. In terms of practicality, it is preferable that the knob length be within the range between 50 mm and 100 mm.

The raised portion 38 of the knob body 37 is formed at an intermediate position of the knob body 37 in a longitudinal direction thereof so as to protrude obliquely frontward and upward. The raised portion 38 has a circular end face portion 39 facing obliquely frontward and upward, and a switch button 40 adapted to be pushable while the damping control lever 34 is operated is provided in the center of the end face portion 39. The switch button 40 has a columnar shape having an outer diameter that is smaller than an outer diameter of the end face portion 39. The switch button 40 is configured to be switchable between ON and OFF. The switch button 40 is ON when pushed in and OFF when returned to its unpushed state. The switch button 40 has a pressure receiving surface that is larger than that of the switch button 33 of the tilt control lever 30. Thus, the switch button 40 is easy to push.

Figure 4B:
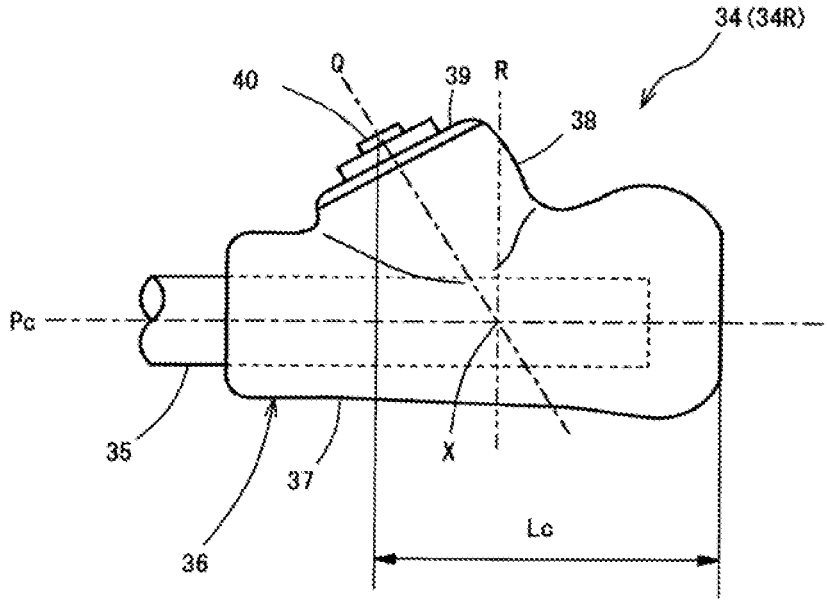
FIG. 4B is a side view of the main part of the clamping control lever of FIG. 4A.

As illustrated in FIGS. 4A and 4B, the control knob 36 extends in its longitudinal direction along an extending direction of a central axis Pc of the rear end portion of the clamping control lever body 35. The central axis Pc passes through the center of the rear end portion of the clamping control lever body 35. In the control knob 36, the switch button 40 has a movement axis Q, which is an imaginary axis passing through the centers of the switch button 40 and the raised portion 38. The movement axis Q is inclined at an angle of 60 degrees relative to the central axis Pc of the control lever body 35. The movement axis Q indicates movable direction of the switch button 40, including the pushing direction of the switch button 40. It is noted that in FIG. 4, an imaginary line R is drawn that is passing through an intersection X between the central axis Pc and the movement axis Q and that is orthogonal to the central axis Pc. Thus, the movement axis Q of the switch button 40 is inclined forward at an angle of 30 degrees relative to the imaginary line R that is orthogonal to the central axis Pc extending along the extending direction of the control knob 36. That is, the movement axis Q is inclined forward at 30 degrees relative to the imaginary line R so that the pushing direction of the switch button 40 is directed rearward from the direction that is orthogonal to the extending direction of the control knob 36.

The reason for the 30-degree forward inclination of the movement axis Q of the switch button 40 relative to the imaginary line R is that the operator can push the switch button 40 easily with a finger. Also, since the switch button 40 has the pressure receiving surface that is larger than that of the switch button 33 of the tilt control lever 30, the load necessary for pushing the switch button 40 of the clamping control lever 34 is reduced by 40% as compared, for example, with the switch button 33 of the tilt control lever 30.

When the operator tilts the clamping control lever 34 (34R) forward while pushing the switch button 40, the clamp arm 22R is moved rightward. When the operator tilts the clamping control lever 34 (34L) forward while pushing the switch button 40, the clamp arm 22L is moved leftward. That is, by tilting the damping control lever 34R or 34L forward with the switch button 40 pushed in, the clamp arm 22R or 22L is moved in a direction away from the other clamp arm (the opening direction) so that the clamp arms 22R and 22L are opened. When the switch button 40 of the clamping control lever 34R or 34L is not pushed in, the clamp arm 22R or 22L is not opened even though the clamping control lever 34R or 34L is tilted forward.

When the operator tilts the clamping control lever 34 (34R) rearward, the damp arm 22R is moved leftward. When the operator tilts the damping control lever 34 (34L) rearward, the damp arm 22L is moved rightward. That is, by tilting the damping control lever 34R or 34L rearward, the damp arm 22R or 22L is moved toward the other damp arm in a direction in which the clamp arms 22R and 22L are closed. The switch buttons 40 need not be pushed in when moving the clamp arms 22R and 22L in the closing direction.

Figure 5A:
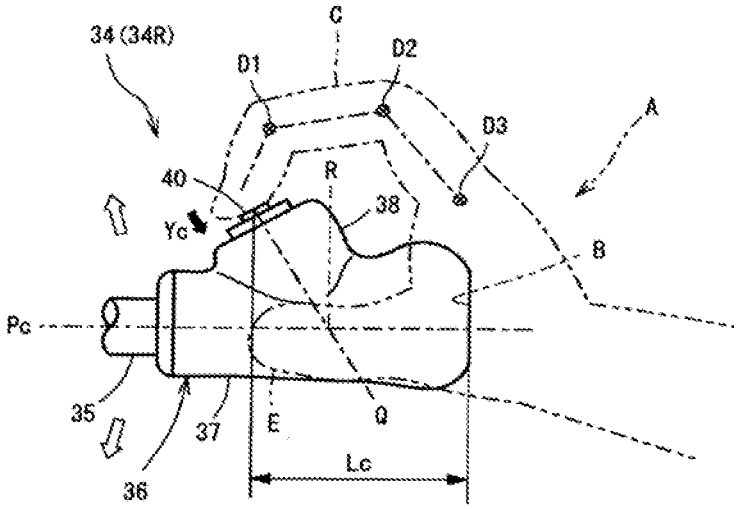
FIG. 5A is a view schematically showing a positional relationship between the clamping control lever and a hand of an operator.

The following will describe the operation of the control lever device 25 according to the first embodiment. Here, operation of the clamping control levers 34R and 34L for opening and closing the damp arms 22R and 22L is described. For example, when the clamping control lever 34R is operated, the operator places a lower palm B of his/her right hand A on the control knob 36, places the pad of the index finger C on the distal end side from the distal interphalangeal joint D1 on the switch button 40, and holds the control knob 36 with the thumb E and the remaining fingers (not illustrated), as illustrated in FIG. 5A. In this state, the operator is able to tilt the damping control lever 34R forward while pushing the switch button 40.

When the operator tilts the damping control lever 34R forward while pushing the switch button 40, the clamp cylinder is actuated to move the clamp arm 22R in a direction away from the damp arm 22L, i.e., rightward. The distance between the damp arm 22R and the damp arm 22L is increased as the clamp arm 22R is moved rightward.

The forward tilting operation of the damping control lever 34R (or 34L) with the switch button 40 pushed in is an operation performed before clamping a load (not illustrated) with the clamp arms 22R and 22L or when unclamping the load held between the clamp arms 22R and 22L, and the length of time for which the switch buttons 40 are pushed in is relatively longer as compared with operations of other control levers. When the operator tilts the damping control lever 34R forward while pushing the switch button 40, the operator applies a forward load to the damping control lever 34R through the lower palm B of the right hand A by extending his/her right arm, to thereby tilt the damping control lever 34R forward.

The movement axis Q of the switch button 40 is inclined forward at an angle of 30 degrees relative to the imaginary line R. Here, a distance between the intersection of the rear end of the control knob 36 and the central axis Pc and the center of the switch button 40 in the extending direction of the central axis Pc is referred to as distance Lc, as illustrated in FIG. 4A, and a distance between the intersection of the rear end of the control knob 32 of the tilt control lever 30 and the central axis Pt and the center of the switch button 33 in the extending direction of the central axis Pt is referred to as distance Lt, as illustrated in FIG. 3A. Then, the distance Lc is smaller than the distance Lt. Accordingly, when the index finger C is placed on the switch button 40 with the lower palm B of the right hand A placed on the control knob 36, at least the index finger C is bent sufficiently at proximal interphalangeal joint D2. Thus, the operator can apply a pushing force to the switch button 40 easily using a part of the index finger C on the distal end side from the proximal interphalangeal joint D2, with the proximal interphalangeal joint D2 of the index finger C as the fulcrum. In FIG. 5A, the pushing direction of the switch button 40 is indicated by an arrow Yc.

Also, because the movement axis Q of the switch button 40 is inclined forward at an angle of 30 degrees relative to the imaginary line R, the direction in which the pushing force is applied to the switch button 40 using the proximal interphalangeal joint D2 of the index finger C easily aligns with the pushing direction of the switch button 40. Because the switch button 40 may be pushed in using a part of the index finger C on the distal end side from the proximal interphalangeal joint D2, the index finger C does not get tired easily even in a case where the operator keeps pushing the switch button 40 with the index finger C. Also, in FIG. 5A, the forward and rearward tilting directions of the clamping control lever 34 are indicated by blank arrows.

Figure 5B:
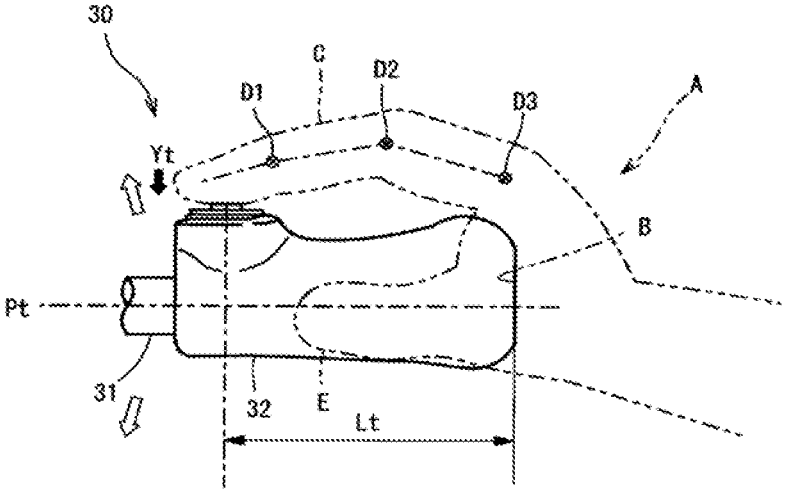
FIG. 5B is a view of a comparative example schematically showing a positional relationship between the tilt control lever and a hand of an operator.

As illustrated in FIG. 5B showing a comparative example, when the index finger C is placed on the switch button 33 of the tilt control lever 30, the distance Lt in the extending direction of the control knob 32 of the tilt control lever 30 is greater than the distance Lc in the extending direction of the control knob 36 of the damping control lever 34. Thus, when the operator places the index finger C on the switch button 33 of the tilt control lever 30, the index finger C is more stretched as compared with the case where the index finger C is placed on the switch button 40 of the damping control lever 34. As a result, in order to push the switch button 33, the operator needs to bend the index finger C at the metacarpophalangeal joint D3.

When the pad of the distal interphalangeal joint D1 of the index finger C is considered as the point of action, then, the proximal interphalangeal joint D2 is the fulcrum when operating the clamping control lever 34 and the metacarpophalangeal joint D3 is the fulcrum when operating the tilt control lever 30. In the case where the metacarpophalangeal joint D3 is the fulcrum, the distance between the fulcrum and the point of action is greater compared with the case where the proximal interphalangeal joint D2 is the fulcrum. Thus, in such a case, a larger load is required for pushing the switch button 33 of the tilt control lever 30 than for pushing the switch button 40 of the clamping control lever 34. In this case, the operator needs to increase the force to push the switch button more than the case where the proximal interphalangeal joint D2 is the fulcrum. The frequency of the use of the switch button 33 of the tilt control lever 30 is extremely smaller than that of the switch button 40 of the damping control lever 34. Therefore, the difficulty of pushing the switch button 33 of the tilt control lever 30 is ignorable for the operator.

The following will describe the rearward tilting of the clamping control lever 34. When the damping control lever 34R is tilted rearward, the clamp cylinder is actuated to move the clamp arm 22R leftward. When the clamping control lever 34R (or 34L) is tilted rearward, the distance between the clamp arm 22R and the clamp arm 22L is reduced. While the clamping control lever 34R (or 34L) is tilted rearward, the clamp arms 22R (or 22L) may be moved in the closing direction without pushing the switch button 40.

The control lever device 25 of the first embodiment offers the following effects.

(1) The switch button 40 of the clamping control lever 34 is provided on the upper portion of the control knob 36. The switch button 40 has the movement axis Q indicating the movable direction of the switch button 40, and the movement axis Q is inclined forward relative to a direction orthogonal to the extending direction of the control knob 36 so that the pushing direction of the switch button 40 is directed rearward from the orthogonal direction. Thus, even when the operator keeps pushing the switch button 40 during the operation of the clamping control lever 34, application of a pushing force to the switch button 40 is easier as compared with the switch button 33 of the tilt control lever 30 that is positioned orthogonal to the extending direction of the control knob 32. As a result, operation of the clamping control lever 34 is easier and the finger pushing the switch button 40 does not get tired easily.

(2) The maximum forward inclination angle of the movement axis Q of the switch button 40 is defined by the knob length of the control knob 36 and the position of the switch button 40 in the extending direction of the control knob 36. The intersection X of the central axis Pc extending in the extending direction of the control knob 36 and the movement axis Q of the switch button 40 extending in the extending direction of the switch button 40 is located in the control knob 36. Accordingly, a part of the control knob 36 is located between the switch button 40 and the rear end of the control knob 36. Thus, for example, even when the operator places the lower palm B of the right hand A on the rear end of the control knob 36, the switch button 40 is still located at a position easy for the operator to push the switch button 40, so that the operation of the clamping control lever 34 is easier.

(3) The forward inclination angle of the pushing direction of the switch button 40 is 30 degrees, which falls within the range between 20 degrees and 60 degrees. Thus, with the forward inclination angle of the pushing direction within the range between 20 degrees and 60 degrees, the switch button 40 is easier to push in during the operation of the clamping control lever 34.

(4) Furthermore, the control lever device 25 includes a pair of clamping control levers 34 (34R, 34L) configured to operate a pair of clamp arms 22 (22R, 22L) for holding a load therebetween. Thus, when opening the pair of clamp arms 22 (22R, 22L), opening of the pair of damp arms 22 (22R, 22L) is enabled by operating at least one of the clamping control levers 34 (34R, 34L) in the opening direction with the switch button 40 kept pushed in.

(5) The movement axis Q of the switch button 40 is inclined forward at an angle of 30 degrees relative to the imaginary line R. Also, the distance Lc between the intersection of the rear end of the control knob 36 and the central axis Pc and the center of the switch button 40 in the extending direction of the central axis Pc is smaller than the distance Lt between the intersection of the rear end of the control knob 32 of the tilt control lever 30 and the central axis Pt and the center of the switch button 33 in the extending direction of the central axis Pt of the tilt control lever 30. Accordingly, when the index finger C is placed on the switch button 40 with the lower palm B of the right hand A placed on the control knob 36, at least the index finger C is bent sufficiently at the proximal interphalangeal joint D2. Accordingly, the operator can push the switch button 40 using a part of the index finger C on the distal end side from the proximal intermediate phalangeal joint D2. As a result, the operator's fingers do not get tired easily.

(6) Also, because the movement axis Q of the switch button 40 is inclined forward at an angle of 30 degrees relative to the imaginary line R, the direction in which the pushing force is applied to the switch button 40 using the proximal interphalangeal joint D2 of the index finger C easily aligns with the pushing direction of the switch button 40. Because the switch button 40 may be pushed in using a part of the index finger C on the distal end side from the proximal 1*o* interphalangeal joint D2, the index finger C does not get tired easily even in a case where the operator keeps pushing the switch button 40 with the index finger C.

Second Embodiment

The following will describe a control lever device according to a second embodiment of the present disclosure. The control lever device of the second embodiment is different from the control lever device of the first embodiment in the configuration of the control knob. In the description of the second embodiment, the description of the first embodiment is applied to the configurations that are the same as those of the first embodiment, and the same reference numerals are used.

A control lever device 50 according to the second embodiment includes a pair of clamping control levers 51. It is to be noted that in FIGS. 6A and 6B, only the right clamping control lever 51 (51R) is illustrated and the left clamping control lever is not illustrated. The clamping control levers 51 (51R) includes a clamping control lever body 35 that is slanted obliquely rearward from an instrumental panel 27, and a control knob 52 coupled to a leading end portion (the rear end portion) of the clamping control lever body 35. The control knob 52 includes a knob body 53 and a raised portion 54 formed to rise from the knob body 53. The knob body 53 extends along an extending direction of the clamping control lever body 35. An outer diameter of the control knob 36 is gradually increased as the control knob 36 extends rearward. Part of the rear end portion of the clamping control lever body 35 is inserted into substantially the center of the knob body 53.

Figure 6A:
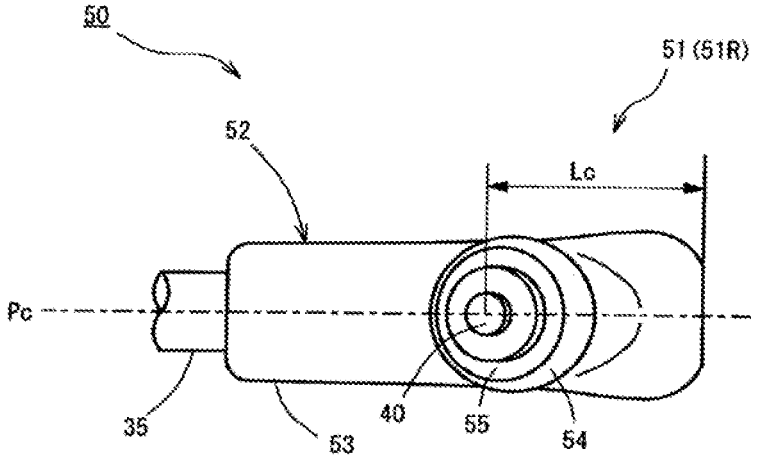
FIG. 6A is a plan view of a main part of a damping control lever of a control lever device according to a second embodiment of the present disclosure.
Figure 6B:
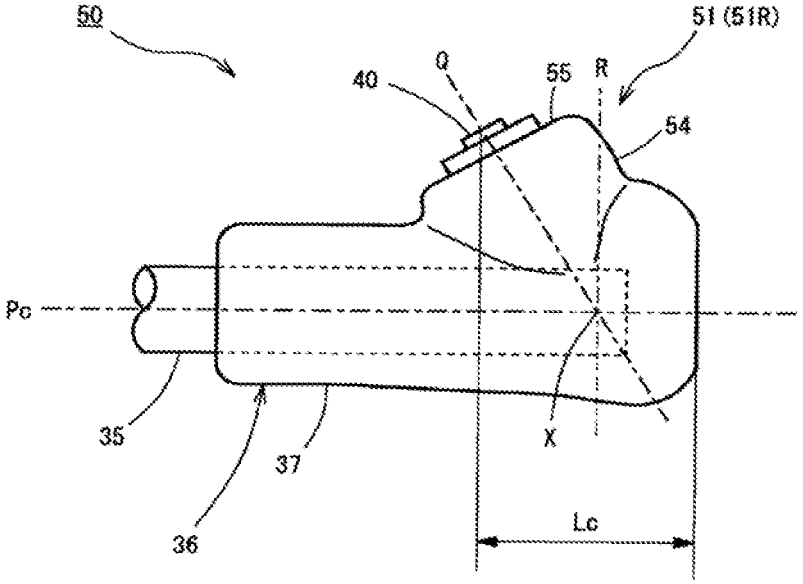
FIG. 6B is a side view of the main part of the clamping control lever of FIG. 6A.

The raised portion 54 of the knob body 53 is formed at a position near the rear end of the knob body 53 in a longitudinal direction thereof so as to protrude obliquely frontward and upward. The raised portion 54 has a circular end face portion 55 facing frontward and upward, and a switch button 40 adapted to be pushable while the clamping control lever 51 is operated is provided at the center 1*o* of the end face portion 55. As illustrated in FIGS. 6A and 68, the control knob 52 extends in its longitudinal direction along an extending direction of a central axis Pc of the rear end portion of the clamping control lever body 35. In the control knob 52, a movement axis Q passing through the center of the raised portion 54 is inclined forward at an angle of 30 degrees relative to an imaginary line R. Also, an intersection X between a central axis Pc extending in the extending direction of the control knob 52 and the movement axis Q of the switch button 40 extending in the extending direction of the switch button 40 is located in the control knob 52. Accordingly, a part of the control knob 52 is located between the switch button 40 and the rear end of the control knob 52.

When the operator tilts the right clamping control lever 51 (51R) forward while pushing the switch button 40, the clamp arm 22R is moved rightward. When the operator tilts the left clamping control lever 51 (51L) forward while pushing the switch button, the damp arm 22L is moved leftward. When the switch button 40 of the right damping control lever 51 (51R) and the switch button of the left clamping control lever are not pushed in, the clamp arms 22R or 22L is not moved in the opening direction even though either of the right clamping control lever 51 and the left clamping control lever is tilted forward.

When the operator tilts the right clamping control lever 51 (51R) rearward, the clamp arm 22R is moved leftward. When the operator tilts the left clamping control lever 51 (51L) rearward, the clamp arm 22L is moved rightward. That is, by tilting the clamping control lever SIR or 51L rearward, the clamp arm 22R or 22L is moved toward the other damp arm in a direction in which the clamp arms 22R and 22L are closed. The switch buttons 40 need not be pushed in when moving the damp arms 22R and 22L in the closing direction.

The control lever device 50 according to the second embodiment offers effects equivalent to the effects (1) to (6) of the first embodiment. Furthermore, the raised portion 54 protruding obliquely frontward and upward is formed near the rear end of the knob body 53 in the longitudinal direction thereof. Thus, the operator can push the switch button 40 with the lower palm B placed on the raised portion 54, and tilt the clamping control lever 51 forward without using the remaining fingers to hold the control knob 54, so that burden on the operator is reduced. In addition, the switch button 40 is also easier for operators with short fingers to push in.

It should be noted that present disclosure is not limited to the above embodiments and may be modified variously within the gist of the disclosure. For example, the present disclosure may be modified as described below.

In the above exemplary embodiments, the index finger is used to push the switch button. However, the finger for pushing the switch button is not limited to the index finger. The switch button may be pushed with the middle finger or third finger, as the case may be.

In the above embodiments, the forward inclination angle of the switch button is 30 degrees relative to a direction that is orthogonal to the extending direction of the control knob. However, the forward inclination angle is not limited to 30 degrees. For example, the forward inclination angle may be 45 degrees or any other angles that fall within the range between 20 degrees and 60 degrees. For example, even in a case where the knob length, which is a length of the control knob in the extending direction thereof, is specified beforehand and the switch button is disposed at a position corresponding to the maximum forward inclination angle of the movement axis of the switch button, i.e., 60 degrees, the intersection of the central axis extending along the extending direction of the control knob and the central axis extending along the extending direction of the switch button may be located in the control knob. Accordingly, a part of the control knob may be located between the switch button and the rear end of the control knob, which contributes to an improved easiness of the operation of the switch button. In terms of practicality, the forward inclination angle should more preferably be between 25 degrees and 40 degrees.

In the above embodiments, the raised portion is provided at around the intermediate position or near the rear end of the control knob in the extending direction of the control knob. However, the position of the raised portion is not limited thereto. For example, the raised portion may be provided near the lever body.

In the above embodiments, the center of the button switch is located right above the central axis of the rear end portion of the clamping control lever body of the clamping control lever. However, the position of the center of the button switch is not limited to the position right above the central axis of the rear end portion of the clamping control lever body of the clamping control lever. For example, the center of the button switch may be located at a position where the pushing direction is inclined relative to the central axis of the rear end portion of the clamping control lever body, at least unless the switch button is pushed in the horizontal direction or pushed from below the horizontal level.

In the above embodiments, a pair of right and left clamping control levers is used. However, the clamping control levers are not limited thereto. For example, a pair of clamp arms may be opened/closed with a single clamping control lever. In the above embodiments, although the clamp arms are opened by tilting the clamping control levers forward, the clamp arms may be opened by tilting the damping control levers rearward. In this case, the clamp arms are opened by tilting the clamping control levers rearward with the switch buttons pushed.

In the above embodiments, the control lever device of a forklift truck using a bale clamp as an attachment is described. However, the attachment is not limited thereto. For example, the attachment may be other attachments than the bale damp, such as a roll clamp. Also, the present disclosure is applicable to other industrial vehicles than forklift trucks, such as construction vehicles.

What is claimed is:

1. A control lever device of an industrial vehicle comprising:

a control lever comprising:

a first portion that extends obliquely rearward;

a second portion that is continuous with the first portion and extends rearward; and a control knob that is coupled to the second portion and has a switch button provided on a raised portion protruding from an upper surface of the control knob, the control lever being tiltable forward and rearward with respect to an operator of the industrial vehicle seated in the industrial vehicle, wherein the raised portion is provided at an intermediate position of the upper surface of the control knob and comprises an end face portion facing obliquely forward and upward, the switch button is provided in a center of the end face portion of the raised portion and is adapted to be pushable while the control lever is operated, an upper surface of the end face portion and an upper surface of the switch button are oblique with respect to the upper surface of the control knob, and the switch button has a movement axis indicating a movable direction of the switch button, wherein the movement axis is inclined forward relative to a direction orthogonal to an extending direction of the control knob so that a pushing direction of the switch button is directed rearward and obliquely downward.

2. The control lever device of an industrial vehicle according to claim 1, wherein the control knob has a predetermined knob length in the extending direction of the control knob, and an intersection of a central axis of the second portion of the control lever extending along the extending direction of the control knob and a central axis of the switch button extending along an extending direction of the switch button is located in the control knob.

3. The control lever device of an industrial vehicle according to claim 1, wherein a forward inclination angle of the pushing direction of the switch button is within a range between 20 degrees and 60 degrees.

4. The control lever device of an industrial vehicle according to claim 1, wherein the control lever is a clamping control lever adapted to control a pair of clamp arms for holding a load therebetween.

* * * * *